US009212550B2

(12) United States Patent
Jaramillo

(10) Patent No.: US 9,212,550 B2
(45) Date of Patent: Dec. 15, 2015

(54) SAMPLER CHAMBER ASSEMBLY AND METHODS

(71) Applicant: Schlumberger Technology Corporation, Sugar Land, TX (US)

(72) Inventor: Juan Jaramillo, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 333 days.

(21) Appl. No.: 13/785,872

(22) Filed: Mar. 5, 2013

(65) Prior Publication Data

US 2014/0251604 A1 Sep. 11, 2014

(51) Int. Cl.
*E21B 49/00* (2006.01)
*E21B 49/08* (2006.01)

(52) U.S. Cl.
CPC ..... *E21B 49/081* (2013.01)

(58) Field of Classification Search
CPC ..... E21B 49/00; E21B 49/081
See application file for complete search history.

(56) References Cited

U.S. PATENT DOCUMENTS

| | | | | |
|---|---|---|---|---|
| 3,530,711 | A * | 9/1970 | Tocanne | 73/152.23 |
| 3,677,080 | A * | 7/1972 | Hallmark | 73/152.26 |
| 3,677,081 | A * | 7/1972 | Newton et al. | 73/152.24 |
| 5,934,374 | A | 8/1999 | Hrametz et al. | |
| 6,065,355 | A | 5/2000 | Schultz | |
| 6,092,416 | A | 7/2000 | Halford et al. | |
| 6,216,782 | B1 | 4/2001 | Skinner | |
| 6,279,669 | B1 | 8/2001 | Swietlik et al. | |
| 6,347,666 | B1 | 2/2002 | Langseth | |
| 6,352,110 | B1 | 3/2002 | Langseth et al. | |
| 6,357,525 | B1 | 3/2002 | Langseth et al. | |
| 6,382,315 | B1 | 5/2002 | Langseth | |
| 6,439,306 | B1 | 8/2002 | Patel | |
| 6,467,544 | B1 | 10/2002 | Brown et al. | |
| 6,659,177 | B2 | 12/2003 | Bolze et al. | |
| 6,688,390 | B2 | 2/2004 | Bolze et al. | |
| 7,083,009 | B2 | 8/2006 | Paluch et al. | |
| 7,090,012 | B2 | 8/2006 | Hill et al. | |
| 7,140,436 | B2 | 11/2006 | Grant et al. | |

(Continued)

FOREIGN PATENT DOCUMENTS

| | | |
|---|---|---|
| EP | 911485 A2 | 4/1999 |
| EP | 964131 A2 | 12/1999 |

(Continued)

OTHER PUBLICATIONS

International Search Report and Written Opinion issued in PCT/US2014/020471 on Jun. 16, 2014, 11 pages.

*Primary Examiner* — William P Neuder
(74) *Attorney, Agent, or Firm* — Cathy Hewitt; Kenneth L. Kincaid

(57) ABSTRACT

An apparatus comprising a fluid communication device, a sample chamber, and a coupling assembly. The fluid communication device is operable to establish fluid communication between a downhole tool and a subterranean formation penetrated by a wellbore in which the downhole tool is positioned. The sample chamber is in selectable fluid communication with the formation via the fluid communication device. The coupling assembly mechanically couples the sample chamber within the downhole tool and comprises a cam rotatable between a first position and a second position, wherein the cam preloads the sample chamber when in the first position is disengaged from the sample chamber in the second position.

20 Claims, 10 Drawing Sheets

(56) References Cited

U.S. PATENT DOCUMENTS

| | | | |
|---|---|---|---|
| 7,158,887 | B2 | 1/2007 | Betancourt et al. |
| 7,195,063 | B2 | 3/2007 | Nogueira et al. |
| 7,198,105 | B2 | 4/2007 | Grant et al. |
| 7,243,536 | B2 | 7/2007 | Bolze et al. |
| 7,246,664 | B2 | 7/2007 | Shammai et al. |
| 7,258,167 | B2 | 8/2007 | Shammai et al. |
| 7,293,715 | B2 | 11/2007 | Bargach et al. |
| 7,367,394 | B2 | 5/2008 | Villareal et al. |
| 7,379,819 | B2 | 5/2008 | Betancourt et al. |
| 7,546,885 | B2 | 6/2009 | Longfield |
| 7,596,995 | B2 | 10/2009 | Irani et al. |
| 7,621,325 | B2 | 11/2009 | Shammai et al. |
| 7,669,469 | B2 | 3/2010 | Shammai et al. |
| 7,775,276 | B2 | 8/2010 | Pelletier et al. |
| 7,845,405 | B2 | 12/2010 | Villareal et al. |
| 7,874,206 | B2 | 1/2011 | Irani et al. |
| 7,886,821 | B2 | 2/2011 | DiFoggio |
| 7,946,166 | B2 | 5/2011 | Irani et al. |
| 7,950,277 | B2 | 5/2011 | Irani et al. |
| 7,958,936 | B2 | 6/2011 | McGregor et al. |
| 7,966,876 | B2 | 6/2011 | Irani et al. |
| 8,056,625 | B2 | 11/2011 | Villareal et al. |
| 8,118,097 | B2 | 2/2012 | Villareal et al. |
| 8,122,956 | B2 | 2/2012 | Shammai et al. |
| 8,151,878 | B2 | 4/2012 | Georgi et al. |
| 2009/0293606 | A1 | 12/2009 | Irani et al. |
| 2010/0326727 | A1 | 12/2010 | Villareal et al. |
| 2011/0220412 | A1 | 9/2011 | Villareal et al. |
| 2012/0097385 | A1 | 4/2012 | Villareal et al. |

FOREIGN PATENT DOCUMENTS

| | | | |
|---|---|---|---|
| WO | 2011102839 | A1 | 8/2011 |
| WO | 2011102840 | A1 | 8/2011 |
| WO | 2011103525 | A2 | 8/2011 |
| WO | 2012054038 | A1 | 4/2012 |

* cited by examiner

SAMPLER CHAMBER ASSEMBLY AND METHODS

BACKGROUND OF THE DISCLOSURE

Wellbores are drilled to locate and produce hydrocarbons by advancing a drilling tool coupled to a drill bit into the ground. Drilling and other downhole tools may be provided with and/or coupled to one or more devices operable downhole to sample fluid from the surrounding formation. The drilling tool may be removed and a wireline tool may be deployed into the wellbore to sample fluid from the formation. Samples are collected in one or more sample chambers positioned in the downhole drilling or wireline tool. The sample chambers may be mounted near the outer perimeter of a collar of the tool to facilitate their removal on the rig floor. However, the tool collar may be subjected to rotational bending and other stresses during operations.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
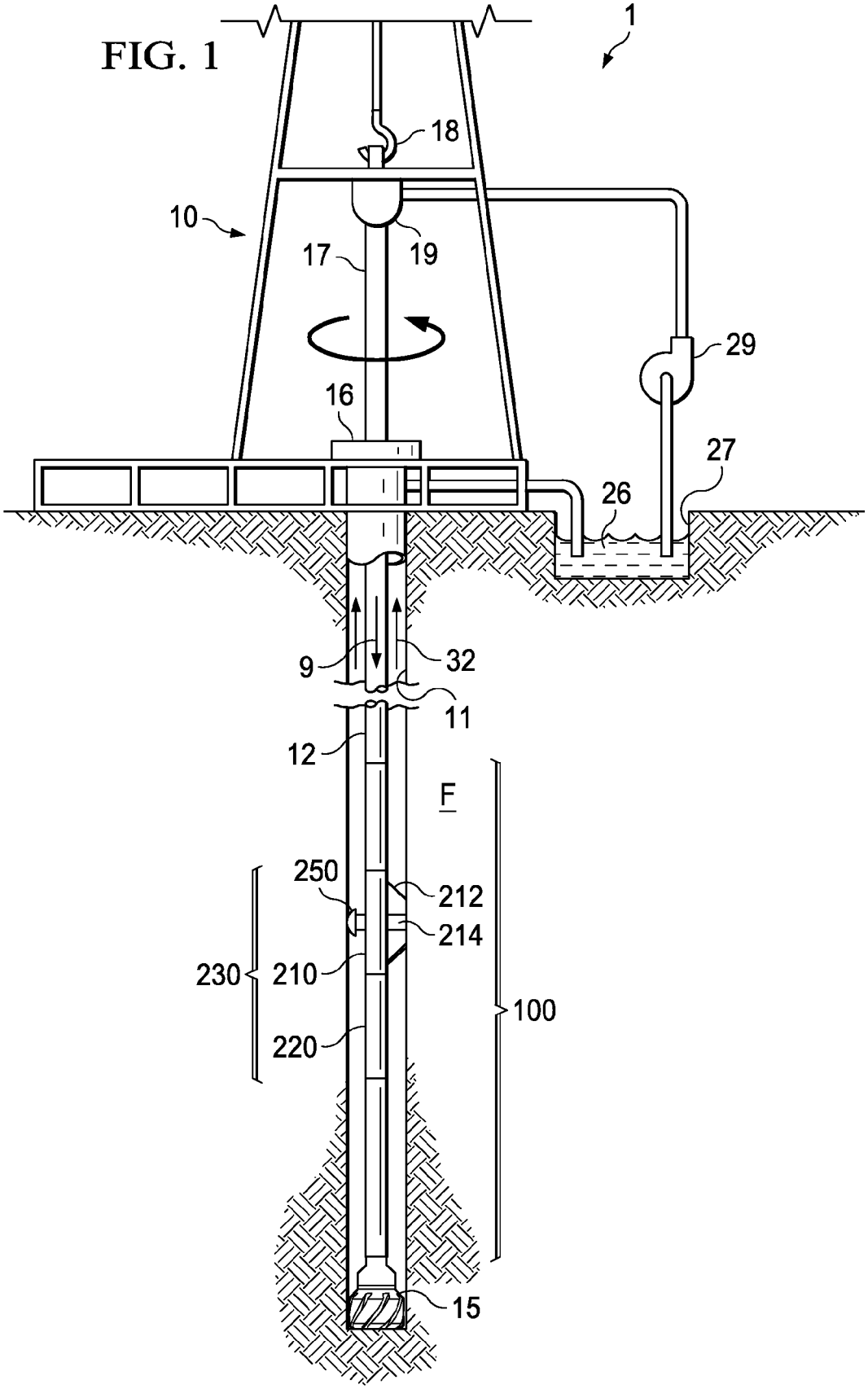
FIG. 1 is a schematic view of an embodiment of a wellsite system that may employ sample chamber assemblies, according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed except where specifically noted as indicating a relationship.

FIG. 1 is a schematic view of at least a portion of an apparatus according to one or more aspects of the present disclosure. Depicted components include a wellsite 1, a rig 10, and a downhole tool 100 suspended from the rig 10 into a wellbore 11 via a drill string 12. The downhole tool 100 has a drill bit 15 at its lower end that is used to advance the downhole tool into the formation and form the wellbore. The drillstring 12 is rotated by a rotary table 16 that engages a kelly 17 at the upper end of the drillstring. The drillstring 12 is suspended from a hook 18, attached to a traveling block (not shown), through the kelly 17 and a rotary swivel 19 that permits rotation of the drillstring relative to the hook.

Drilling fluid or mud 26 is stored in a pit 27 formed at the well site. A pump 29 delivers drilling fluid 26 to the interior of the drillstring 12 via a port in the swivel 19, inducing the drilling fluid to flow downward through the drillstring 12, as indicated in FIG. 1 by directional arrow 9. The drilling fluid 26 exits the drillstring 12 via ports in the drill bit 15, and then circulates upward through the annulus defined between the outside of the drillstring 12 and the wall of the wellbore 11, as indicated by direction arrows 32. The drilling fluid 26 lubricates the drill bit 15 and carries formation cuttings up to the surface as it is returned to the pit 27 for recirculation.

The downhole tool 100, sometimes referred to as a bottom hole assembly ("BHA"), may be positioned near the drill bit 15 (e.g., within several drill collar lengths from the drill bit). The downhole tool 100 includes components with various capabilities, such as measuring, processing, and storing information. A telemetry device (not shown) is also provided for communicating with a surface unit (not shown).

The downhole tool 100 also includes a sampling while drilling ("SWD") system 230 that has a fluid communication module 210 and a sample module 220, which may be individually or collectively housed in one or more drill collars for performing various formation evaluation functions. The fluid communication module 210 may be positioned adjacent the sample module 220, and may include one or more pumps, gauges, sensor, monitors and/or other devices that may also be utilized for downhole sampling and/or testing. The downhole tool 100 shown in FIG. 1 is depicted as having a modular construction with specific components disposed in certain modules. However, the downhole tool 100 may be unitary or select portions thereof may be modular. The modules and/or the components therein may be positioned in a variety of arrangements throughout the downhole tool 100.

The fluid communication module 210 includes a fluid communication device 214 that may be positioned in a stabilizer blade or rib 212. The fluid communication device 214 may include one or more probes or other inlets for receiving sampled fluid from the formation F and/or the wellbore 11. The fluid communication device 214 also includes a flowline (not shown) extending into the downhole tool 100 for passing fluids therethrough. The fluid communication device 214 may be movable between extended and retracted positions for selectively engaging a wall of the wellbore 11 and acquiring one or more fluid samples from the formation F. The fluid communication module 210 may also include a back-up piston 250 that extends generally opposite from the fluid communication device 214 to assist with positioning the fluid communication device 214 against the wall of the wellbore 11.

Figure 2A:
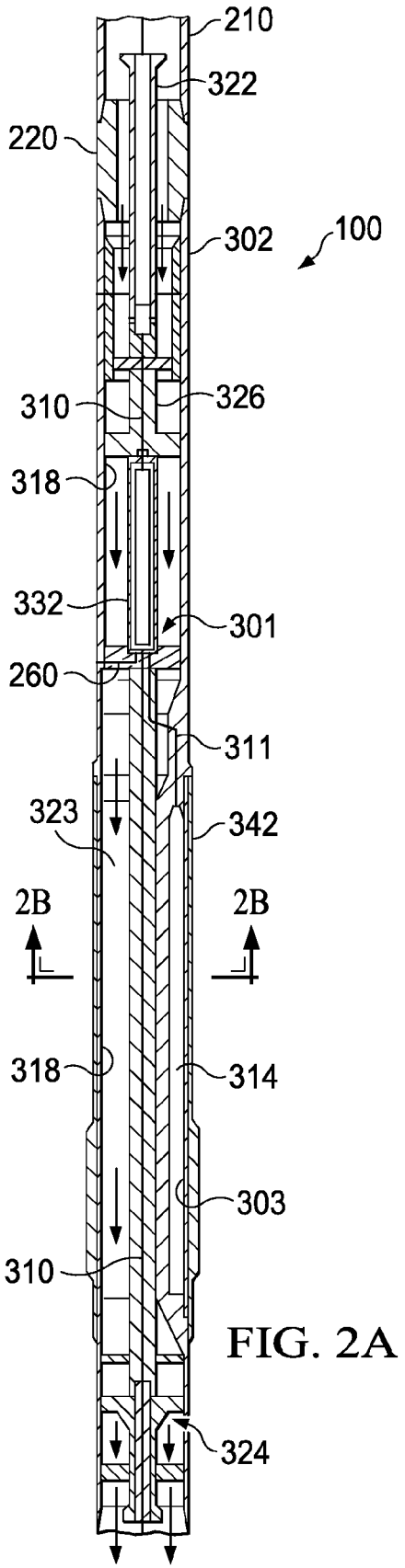
FIG. 2A is a schematic view of a portion of the downhole tool of FIG. 1, according to one or more aspects of the present disclosure.
Figure 2B:
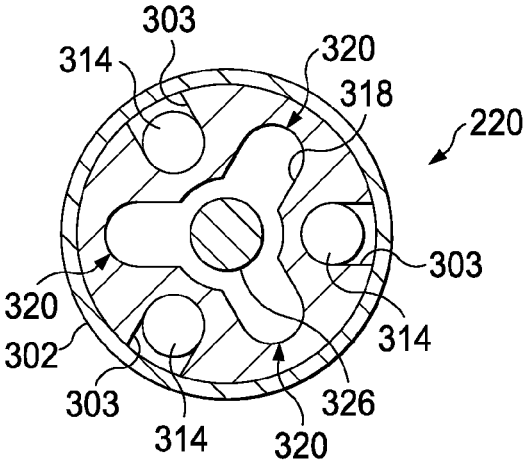
FIG. 2B is a cross-sectional view of the downhole tool of FIG. 2A, according to one or more aspects of the present disclosure.

FIGS. 2A and 2B are schematic views of at least a portion of the downhole tool 100 comprising the sample module 220 of FIG. 1 shown in greater detail. FIG. 2A is a longitudinal cross-section of at least a portion of the fluid communication module 210 and the sample module 220. FIG. 2B is a horizontal cross-section of the sample module 220 taken along section line 2B-2B of FIG. 2A.

The sample module 220 may be housed in a drill collar 302 that is threadedly connectable to adjacent drill collars of the downhole tool 100, such as the fluid communication module 210. The drill collar 302 may include a mandrel 326 supported therein. A passage 323 may extend between the mandrel 326 and the drill collar 302 to permit the passage of mud therethrough (indicated by arrows in FIG. 2A). The sample module 220 may also include an interface 322 at an end thereof to provide hydraulic and/or electrical connections with the fluid communication module 210 and/or another adjacent drill collar or module. An additional interface 324 may be provided at another end to operatively connect to adjacent drill collars if desired. In this manner, fluid and/or signals may be passed between the sample module 220 and other modules. For example, such an interface may be provided to establish fluid communication between the fluid communication module 210 and the sample module 220 to pass formation fluid received by the fluid communication module 210 to the sample module 220.

The interface 322 is depicted in FIG. 2A as disposed at an uphole end of the sample module 220 for operative connection with the adjacent fluid communication module 210. However, in other embodiments, one or more fluid communication and/or sample modules may be positioned in the downhole tool 100 with one or more interfaces (e.g., interface 322, interface 324, and/or others) at either or both ends thereof for operative connection with adjacent modules. One or more intervening modules also may be positioned between the fluid communication module 210 and the sample module 220.

The sample module 220 includes a fluid flow system 301 for passing fluid therethrough. The fluid flow system 301 may include a primary flowline 310 that extends from the interface 322 and into the downhole tool 100. The flowline 310 may be in fluid communication with a similar flowline of the fluid communication module 210 via the interface 322 for receiving fluids received thereby. The flowline 310 may be positioned in the mandrel 326 in a manner that permits passage of fluid received from the fluid communication module 210 through the sample module 220.

The fluid flow system 301 may also include a secondary flowline 311 and a dump flowline 260. The secondary flowline 311 may divert fluid from the primary flowline 310 to one or more sample chambers 314 for collection therein. The dump flowline 260 and/or other flowlines may also be provided to divert flow to the wellbore 11 and/or other locations in the downhole tool 100. For example, one or more flow diverters 332 may be operable to selectively divert fluid to locations, such as sample chambers and/or the wellbore.

The sample chambers 314 may include one or more valves, pistons, pressure chambers, and/or other devices operable to assist in capturing formation fluid and/or maintaining the quality of the formation fluid. The sample chambers 314 are each operable to receive sampled formation fluid acquired via the fluid communication device 214 (see FIG. 1) via the primary flowline 310 and the respective secondary flowlines 311. The sample chambers are removably positioned in corresponding apertures 303 extending through the outer perimeter of the drill collar 302. One or more covers 342 may be positioned over one or more of the apertures 303 to assist in retaining the sample chambers 314 and protecting them from the drilling environment.

As seen in the horizontal cross-section taken along line 2B-2B of FIG. 2A and shown in FIG. 2B, the sample module 220 may include three sample chambers 314 evenly spaced apart at 120° intervals. However, the sample module 220 may include any number of sample chambers 314 positioned in a variety of arrangements. FIG. 2B also depicts a passage 318 that includes a plurality of radially projecting lobes 320. The number of lobes 320 may be equal to the number of sample chambers 314, such that the lobes 320 may project between the sample chambers 314 at a spacing interval of about 60° therefrom. The lobes 320 expand the flow area of the passage 318 to permit passage of drilling fluid at a greater flow rate than passages of a circular cross-section.

Figure 3:
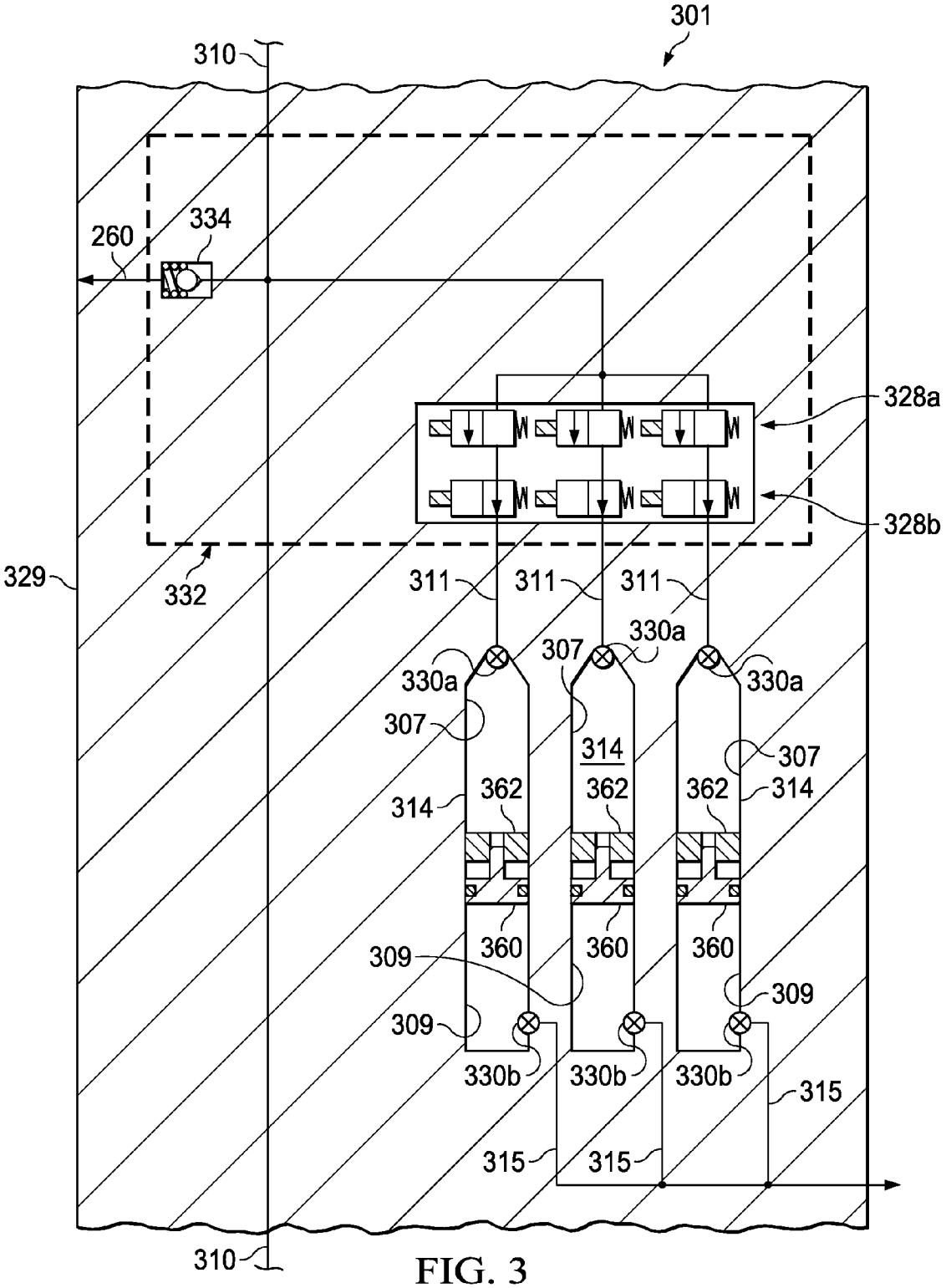
FIG. 3 is a schematic view of an embodiment of a sample module, according to one or more aspects of the present disclosure.

FIG. 3 is a schematic view of at least a portion of the fluid flow system 301 of the sample module 220. As described above, the fluid flow system 301 may include a flow diverter 332 operable to selectively divert flow through the sample module 220 and the sample chambers 314. For example, the flow diverter 332 may selectively divert fluid from the primary flowline 310 to secondary flowlines 311 leading to the sample chambers 314 and/or to the dump flowline 260 leading to the wellbore. As shown in FIG. 3, the system 301 of flowlines and valves may be operable to selectively divert fluid to desired locations throughout the downhole tool, such as to the sample chambers 314, the wellbore, the passage 318 and/or other locations as desired.

The secondary flowlines 311 each branch off from the primary flowline 310 and extend to a corresponding sample chamber 314, which in certain embodiments, may include bottles, containers, or other suitable chambers. As shown in FIG. 3, one or more of the sample chambers 314 may include a piston 360 defining a variable volume sample cavity 307 and a variable volume buffer cavity 309. For example, the sample cavity 307 may receive and house a fluid sample, and the buffer cavity 309 may contain a buffer fluid designed to apply a pressure to the piston 360. Thus, the sample chamber 314 may be operable to maintain a pressure differential between the cavities 307/309 that may be sufficient to maintain the pressure of a sample as it flows into the sample cavity 307. One or more of the sample chambers 314 may also include or be utilized in conjunction with one or more pressure compensators, pressure chambers, sensors and/or other components. One or more of the sample chambers 314 may include an agitator 362, such as a rotating blade and/or other mixing device that moves the fluid in the sample chamber 314.

Each sample chamber 314 may include one or more valves 330*a* operable to selectively fluidly connect the sample cavity 307 of the sample chambers 314 to their corresponding flowline 311. Each sample chamber 314 may also include one or more valves 330*b* operable to selectively fluidly connect the buffer cavity 309 of the sample chambers 314 to a pressure source, such as the wellbore, a nitrogen charging chamber, and/or another pressure source. Each sample chamber 314 may be fluidly coupled to a set of flowline valves 328*a*, 328*b* inside the flow diverter 332, which may be operable to control the flow of fluid into the sample chamber. One or more of the flowline valves 328*a*, 328*b* may be selectively activated to permit fluid from the flowline 310 to enter the sample cavity 307 of one or more of the sample chambers 314. Check valves, two-position valves, three-position valves, and/or other types of valves may be utilized as the flowline valves 328, 328*b* and/or other valves within the flow system 301.

A relief or check valve 334 may be provided in (or in communication with) the dump flowline 260 to allow selective fluid communication with the wellbore, such that formation fluid may be ejected through an inlet and/or other opening in the tool body's sidewall 329. The valve 334 may also be open, or may be selectively opened, to the wellbore at a given differential pressure setting. The valve 334 may be a relief or seal valve that is controlled passively, actively, or by a preset relief pressure. The valve 334 may be operable to flush the flowline 310 before sampling and/or to prevent over-pressuring of fluid samples pumped into the respective sample chambers 314. The relief valve 334 may also be operable as a safety to prevent trapping high pressure at the surface.

Additional flowlines and valves also may be provided as desired to manipulate the flow of fluid through the tool. For example, the fluid flow system 301 also may include a wellbore flowline 315 operable to establish fluid communication between the wellbore and the buffer cavities 309 of the sample chambers 314 via operation of the valves 330*b*.

The downhole tool 100 (FIG. 1) may include more than one instance of the sample module 220. In these and other implementations, the respective relief valves 334 may be operated in a selective fashion. For example, the respective relief valves 334 of the multiple sample modules 220 may be operable to be active when the sample chambers 314 of each respective sample module 220 are being filled. Thus, while fluid samples are routed to a first sample module 220, its corresponding relief valve 334 may be operable. Once the sample chambers 314 of the first sample module 220 are filled, its relief valve may be disabled, and the relief valve 334 of a second sample module 220 may then be enabled to permit flushing of one or more flowlines therein prior to sample acquisition. Such configuration may also be operable to assist with over-pressure protection. The position and activation of such valves may be actuated manually or automatically to achieve the desired operation.

As described above, the valves 328*a*, 328*b* may be provided in the flowlines 311 to permit selective fluid communication between the primary flowline 310 and the sample cavities 307. These valves 328*a*, 328*b* may be selectively actuated to open and close the secondary flowlines 311 sequentially or independently. The valves 328*a*, 328*b* may be electric valves operable to selectively permit fluid communication, and may include a spring-loaded stem (not shown) operable to bias the valves to either an open or closed position. For example, one or more of the valves 328*a*, 328*b* may be a commercially available exo-valve having a washer operable to fail in response to an applied electrical current, which in turn releases one or more internal springs that then bias the stem into its normal position. Thus, for example, fluid sample storage may be achieved by actuating the valves 328*a* from the displaced closed positions to the normal open positions, which allows fluid samples to enter and fill the sample chambers 314. The collected samples may be sealed in the sample chambers 314 by actuating the valves 328*b* from the displaced open positions to the normal closed positions.

Once the sample chambers 314 are sealed, and the sample module 220 is retrieved to surface, the sample chambers 314 may be removed for testing, evaluation and/or transport. For example, the valves 330*a* may be actuated to provide physical access by an operator at the surface, such as where the sample module 220 includes one or more protective covers (as described below) comprising a window for quickly accessing the manually-operable valves, even when the cover is in a position closing the sample chamber apertures 313 (e.g., see FIG. 4). The valves 330*b* may remain open to expose the backside of the pistons 360 to wellbore fluid pressure, in some instances, during retrieval of the sample module 220 from the wellbore.

One or more of the valves described above may be remotely controlled from the surface by utilizing, for example, standard mud-pulse telemetry, wired drill pipe, and/or other suitable telemetry means. The sample module 220 may be equipped with its own modem and electronics (not shown) for deciphering and executing the telemetry signals. Downhole processors may also be provided to assist with such actuation.

Figure 4:
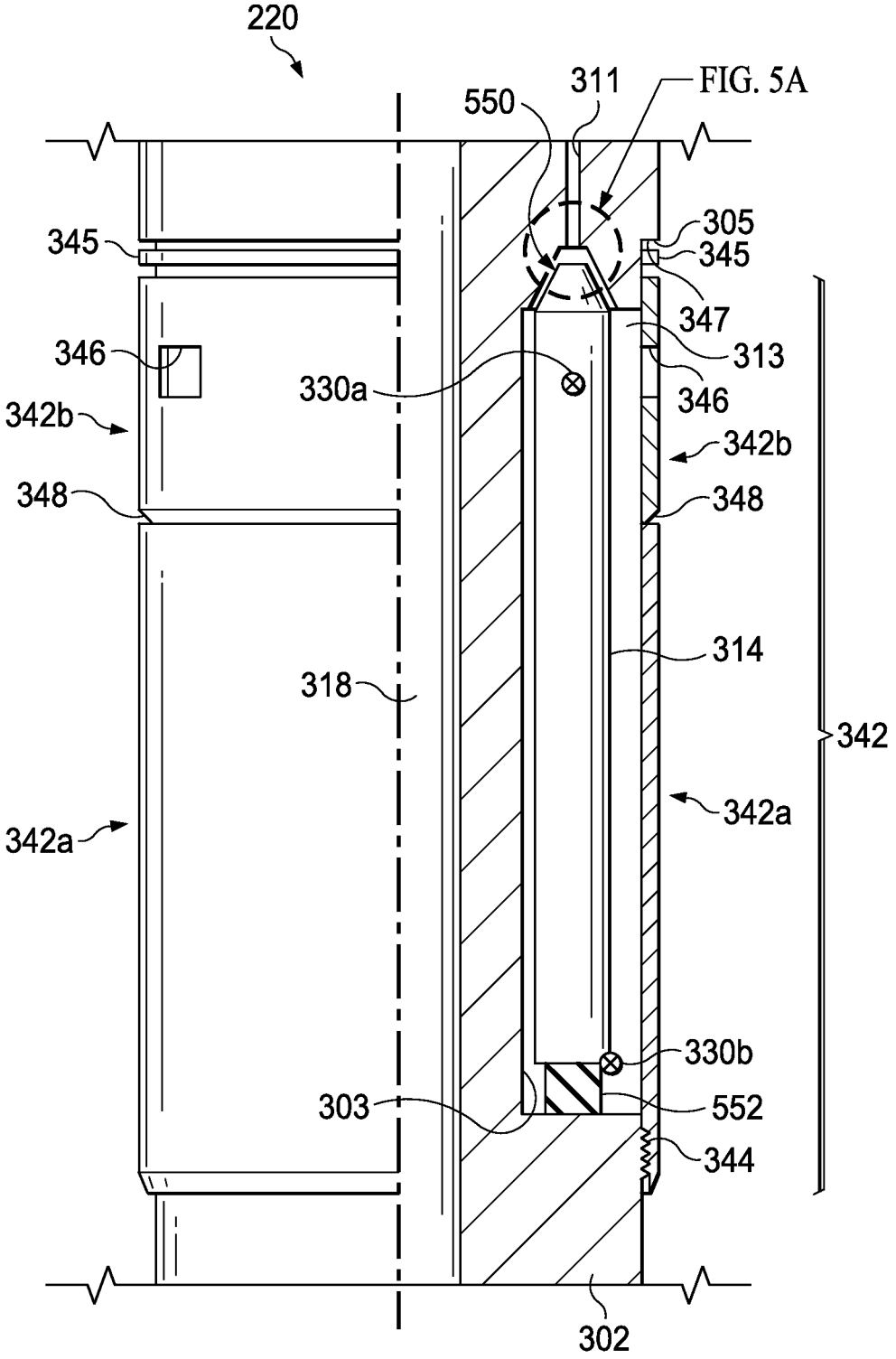
FIG. 4 is a cross-sectional view of an embodiment of a sample module, according to one or more aspects of the present disclosure.

FIG. 4 is a schematic view of the sample module 220 depicting one or more aspects of removably positioning the sample chambers 314 in the sample module 220 within the scope of the present disclosure. As shown in FIG. 4, the sample chamber 314 may be retained within the sample module 220 by a ring, sleeve and/or other type of cover (herein collectively referred to as "cover") slidably positioned about the outer surface of the sample module 220 to cover one or more openings therein.

In FIG. 4, the sample chamber 314 is positioned in the aperture 303 in the outer surface of the drill collar 302 housing the sample module 220. The drill collar 302 includes a passage 318 for directing mud, or other drilling fluid, therethrough. A cover 342 is positioned around or over the drill collar 302 to retain the sample chamber 314 in the sample module 220. The cover 342 may be or include one or more rings, sleeves, and/or other members slidably positionable about the drill collar 302 to provide access to one or more of the sample chambers 314. Such access may, for example, permit insertion and withdrawal of the sample chambers 314 from the drill collar 302 without requiring access to the ends of the sample module 220. For example, the cover 342 may be a protective cylindrical cover that fits closely over a portion of the drill collar 302, and that is movable between positions closing (FIG. 4) and exposing (not shown) one or more of the apertures 303 in the drill collar. The cover 342 may thus prevent the entry of cuttings and/or other large particles from the wellbore into the aperture(s) 303 when in the closed position.

The cover 342 may be formed as a single piece, or it may include two or more complementing sections. For example, FIG. 4 depicts the cover 342 as comprising first and second cover sections 342*a*, 342*b*. Both cover sections 342*a*, 342*b* may be slidably positioned about an opening or recess 305 in the outer perimeter of the drill collar 302. The first cover section 342*a* may slide upward relative to the drill collar 302 until it abuts a downward-facing shoulder 347 of the opening 305. A shim, bellows, spring-washer stack, and/or other device 345 may be positioned between the shoulder 347 and the cover 342 to absorb axial loading of the cover 342. The cover sections 342*a*, 342*b* may have complementing stops (referenced as 348) adapted for operative connection therebetween. The cover 342 may be threaded onto the drill collar 302, such as at threaded connection 344.

The cover 342 may be removed from the drill collar 302 to access one or more of the sample chambers 314. For example, the cover 342 may be rotated to un-mate the threaded connection 344. The cover 342 may also include one or more windows 346 that may be utilized to access one or more of the sample chambers 314. For example, the window 346 shown in FIG. 4 may be utilized to access the valves 330*a*, 330*b* corresponding to one or more of the sample chambers 314 at the surface without removing the cover 342.

Inside the cover 342, the sample chambers 314 are removably supported in the sample module 220. For example, in the example depicted in FIG. 4, the sample chamber 314 is supported at one end by an interface 550 operable to connect the sample chamber 314 to the flowline 311 within the sample module 220. Another interface 552 supports the other end of the sample chamber 314. Additional details regarding the interfaces 550 and 552 are provided below.

Components for protecting the sample chambers 314 from the downhole environment other than the cover 342 shown in FIG. 4 are also within the scope of the present disclosure. For example, other components for protecting the sample chambers 314 from the downhole environment may include cover members that may slidingly engage an inner surface of the drill collar 302, as well as cover members that attach to the outer surface of the drill collar 302 via threaded fasteners. One or more portions of the covering components shown in FIG. 4 and/or otherwise within the scope of the present disclosure may also be provided with features and/or devices operable to prevent damage to the covering means and/or the sample chambers 314, such as strain relief features permitting the covering means to function as one or more shields.

Figure 5A:
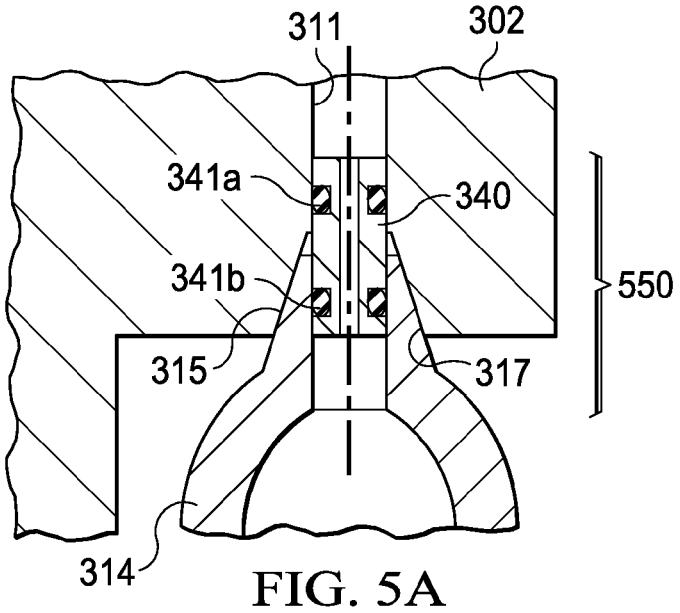
FIG. 5A is a schematic view of an embodiment of a sample chamber interface that may be employed in the sample module of FIG. 4, according to one or more aspects of the present disclosure.

FIG. 5A is a schematic view of a portion of the sample module 220 shown in FIG. 4 depicting the interface 550 in greater detail. The interface 550 includes a hydraulic stabber 340 fluidly connecting the sample chamber 314 to one of the secondary flowlines 311. The sample chamber 314 may have a conical neck 315 having an inlet for passing fluids therethrough. A first portion of the hydraulic stabber 340 may sealingly engage with the conical neck 315 via one or more seals 341*a*, and a second portion of the hydraulic stabber 340 may sealingly engage with the secondary flowline 311 via one or more seals 341*b*. The conical neck 315 of the sample chamber 314 may be received within a complementing conical aperture 317 in the drill collar 302. The conical neck 315 may thus provide lateral support for the sample chamber 314. The conical neck 315 may also be used in combination with other mechanisms, such as an axial loading device (described below), to support the sample chamber 314 within the sample module 220.

Figure 5B:
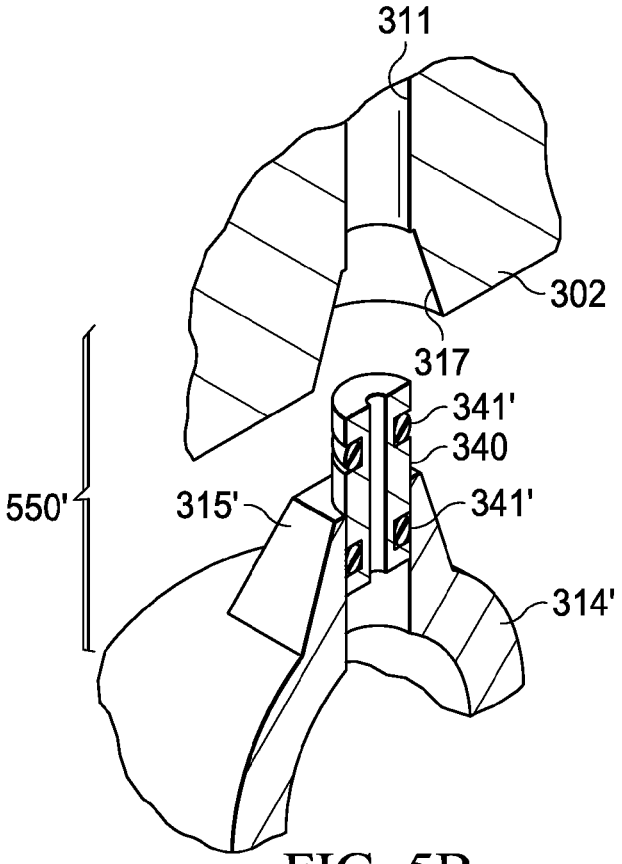
FIG. 5B is a schematic view of another embodiment of a sample chamber interface that may be employed in the sample module of FIG. 4, according to one or more aspects of the present disclosure.

FIG. 5B is a schematic view of a portion of another example of the sample chamber 314 shown in FIG. 4 with an alternate interface 550'. The sample chamber 314' and other components shown in FIG. 5B are substantially similar to those shown in FIG. 5A with the following possible exceptions.

The sample chamber 314' shown in FIG. 5B includes a double-wedge or pyramidal neck 315' that engages a complementing pyramidal aperture 317' in the drill collar 302. As with the example shown in FIG. 5A, the hydraulic stabber 340' shown in FIG. 5B is positioned in an inlet in the pyramidal neck 315' for insertion into the pyramidal aperture 317' to fluidly couple the sample chamber 314' to the flowline 311. Hydraulic seals 341' may also be provided in a manner similar to as described above with respect to FIG. 5A.

The pyramidal engagement shown in FIG. 5B may provide torsional support for the sample chamber, and as such may be operable to resist rotation of the sample chamber 314' about its axis. This functionality may aid alignment of the manually operated valves 330*a* and 330*b* (FIG. 3) within the openings 313 in which the sample chambers 314' are retained.

Figure 6A:
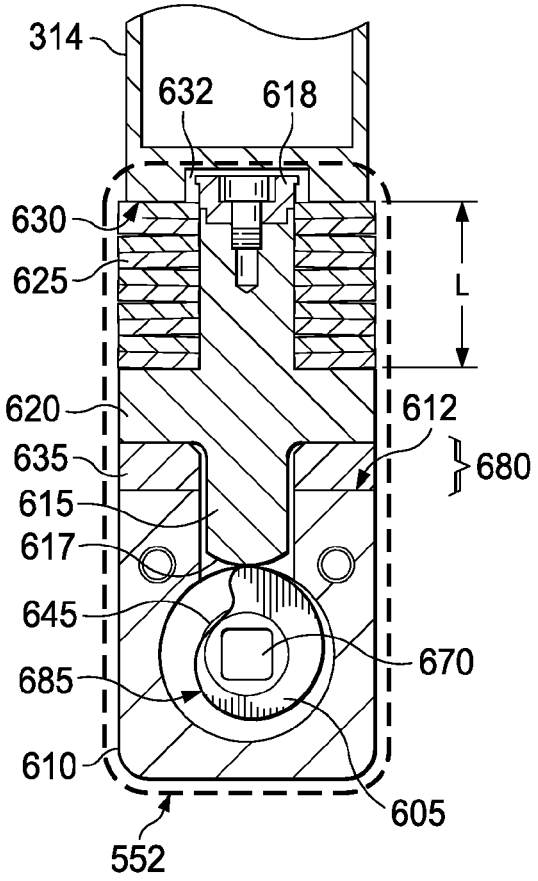
FIG. 6A is a schematic view of an embodiment of a sample chamber interface, shown in an intermediate position, that may be employed in the sample module of FIG. 4, according to one or more aspects of the present disclosure.
Figure 6B:
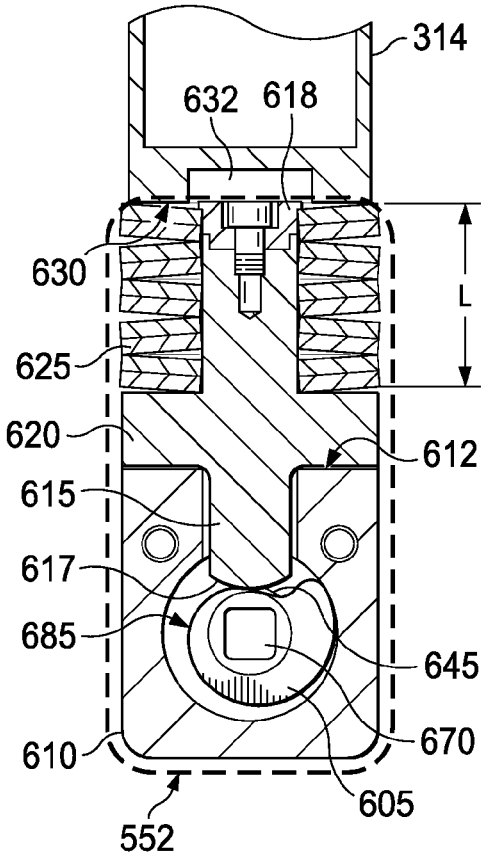
FIG. 6B is a schematic view of the sample chamber interface of FIG. 6A in a loading position, according to one or more aspects of the present disclosure.
Figure 6C:
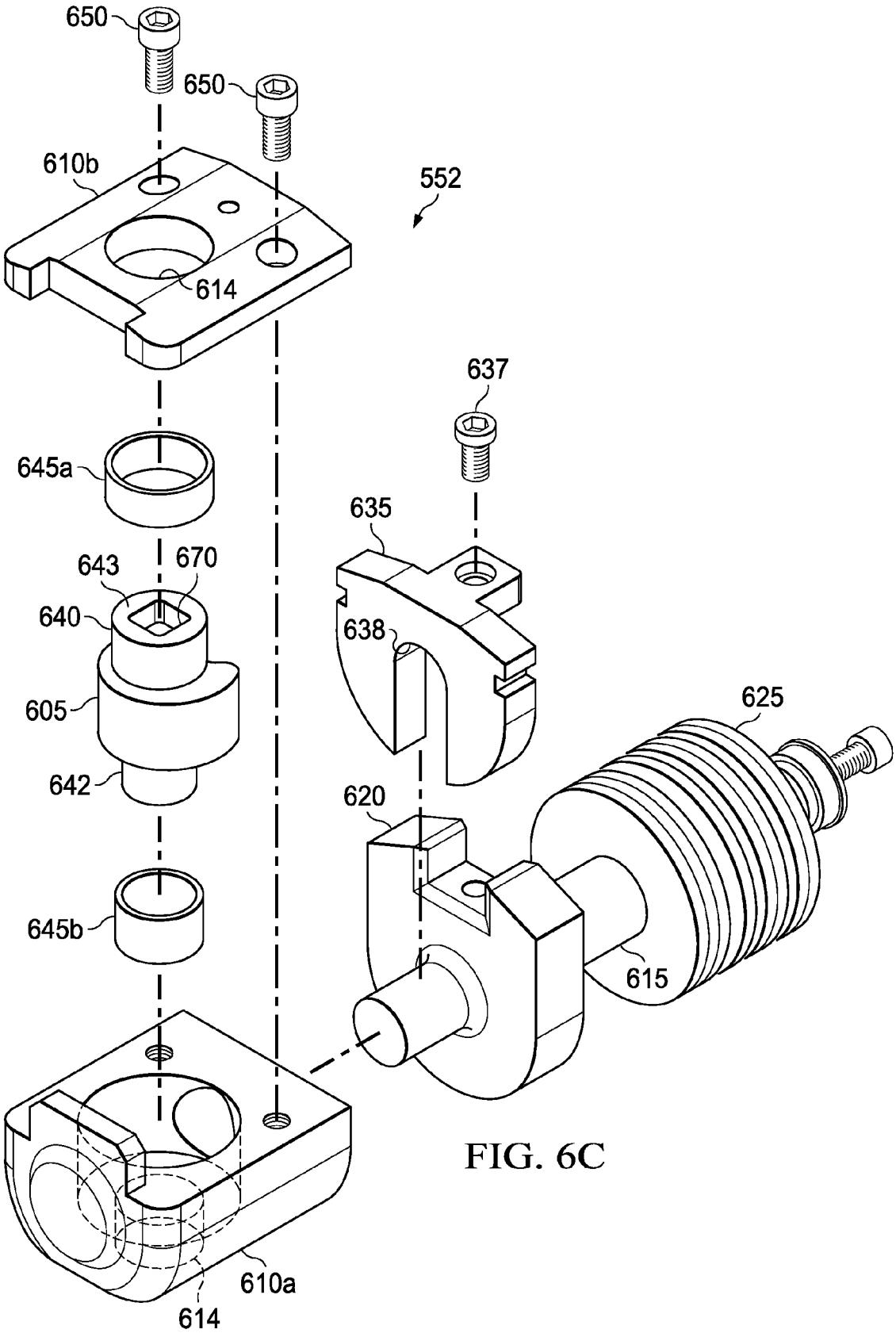
FIG. 6C is an exploded view of the sample chamber interface of FIG. 6A, according to one or more aspects of the present disclosure.
Figure 6D:
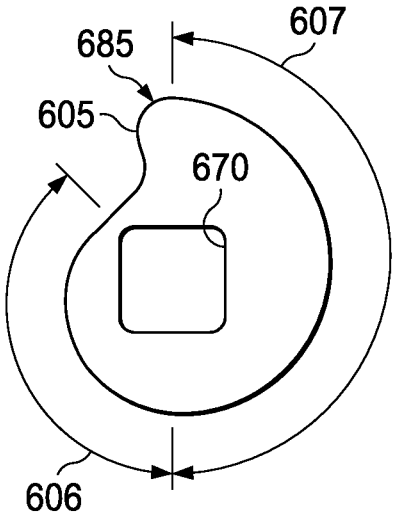
FIG. 6D is a top view of the cam of FIG. 6C, according to one or more aspects of the present disclosure.
Figure 6E:
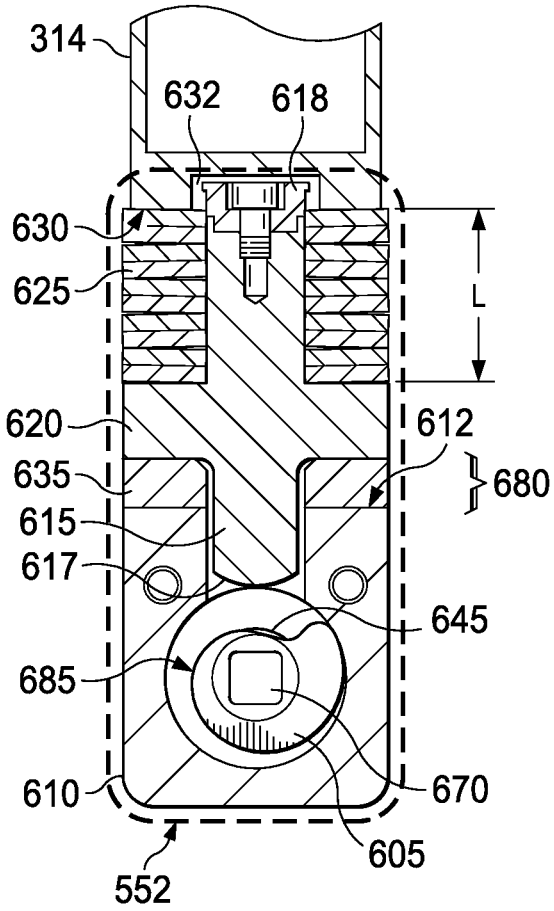
FIG. 6E is a schematic view the sample chamber interface of FIG. 6A in a sampling position, according to one or more aspects of the present disclosure.

FIGS. 6A, 6B, 6C, 6D, and 6E are schematic views of a portion of the sample module 220 depicting the interface 552 shown in FIG. 4, according to one or more aspects of the present disclosure. The interface 552 is operable to mechanically couple the sample chamber 314 within the sample module 220, and facilitates insertion and removal of the sample chamber 314 from the sample module 220. As described further below, FIG. 6B depicts the interface 552 in a loading configuration, where the sample chamber 314 may be inserted into the sample module 220. After the sample chamber has been inserted, a cam 605 may be rotated and a spacer 635 may be inserted while the interface 552 is in an intermediate configuration, as shown in FIG. 6A. Once the spacer 635 has been inserted, the cam 605 may be rotated back to its previous position, to place the interface 552 in a sampling configuration, as shown in FIG. 6E. The sample module 220 may then be conveyed downhole to perform sampling operations.

The interface 552 includes the cam 605, which is rotatable between a first position shown in FIG. 6A where the cam 605 is engaged with the shaft 615, and a second position shown in FIGS. 6B and 6E where the cam 605 is disengaged from the shaft 615. The cam 605 is operable to preload the sample chamber 314 when in the first position but is disengaged from the sample chamber 314 in the second position. In other words, in the first position, the cam 605 is operable to apply an axial force to the sample chamber 314 to secure the chamber 314 in place, while in the second position, the cam 605 is disengaged from the sample chamber 314 so that the cam 605 does not apply axial force to the sample chamber 304, allowing insertion and removal of the sample chamber from the interface 522. The following description includes reference to clockwise and counterclockwise rotation of the cam 605. However, such reference is merely for the sake of clarity and ease of understanding, and those skilled in the art will readily appreciate that the scope of the present disclosure also includes the reverse or opposite rotation of the cam 605 relative to the description below.

A housing 610 retains and/or otherwise supports the cam 605 in a manner permitting rotation of the cam 605 within the housing 610. The interface 552 may include a shaft 615 having an end 617 abutting the cam 605 within the housing 610. In such embodiments, the shaft 615 may carry a follower 620, and a biaser 625 extends between the follower 620 and a shoulder 630 of the sample chamber 314. The length L of the biaser 625 may vary based on axial loading of the sample chamber 314 during downhole operations. For example, the biaser 625 may include a stack of one or more Belleville and/or other types of springs compressible between the shoulder 630 of the sample chamber 314 and the follower 620, and may thus be operable to absorb axial loading of the sample chamber 314 when the cam 605 is in the second position (FIG. 6B).

The end 617 of the shaft 615 is depicted as being rounded or tapered. However, other profiles, such as pointed, triangular, or rectangular profiles, among others, are also within the scope of the present disclosure. The end 617 of the shaft 615 may also be equipped with a cylindrical, spherical, or otherwise shaped roller. In some embodiments, the roller may reduce friction and/or surface wear associated with the contact between the shaft 615 and the cam 605. In other embodiments, however, friction and/or surface wear at such contact may not be a concern, such as where the projected usage (e.g., the estimated number of cycles) is substantially less than the lifespan of the interface 552. In these embodiments, among others within the scope of the present application, the end 617 of the shaft 615 may not include a roller.

A second end 618 of the shaft 615 (which may include an additional member coupled to the shaft, as shown in FIGS. 6A and 6B) is sized for receipt within a recess 632 of the shoulder 630 of the sample chamber 314. For example, the recess 632 and at least the end 618 of the shaft 615 may be substantially cylindrical or otherwise similarly shaped in a manner permitting the end 618 of the shaft 615 to freely travel into and out of the recess 632. The recess 632 may permit axial loading to be transferred through the shaft 615 when the axial force from the sample chamber 314 exceeds the operating force and thus fully compresses the biaser 625. This may help prevent the biaser 625 from being permanently deformed, such as by permitting the excessive axial force to be transferred directly to the drill collar 302.

The shaft 615 and the follower 620 may be integrally formed as a single discrete member assembled within the interface 552. However, the shaft 615 and the follower 620 may each be discrete components coupled together by threading, welding, interference fit, and/or other means. The cam 605 may substantially constructed of a first material, and the shaft 615 and the follower 620 may substantially be constructed of a second material that may be different than the first material. For example, the cam 605 may be substantially or entirely constructed of INCONEL, and the shaft 615 and/or the follower 620 may be substantially or entirely constructed of titanium. However, other materials and combinations are also within the scope of the present disclosure. For example, in other embodiments, the cam 605 and the follower 620 may constructed of 17-4 stainless steel, 13-8 stainless steel, K-MONEL alloy, and/or other stainless steels or alloys, perhaps with QPQ (quench-polish-quench) and/or other surface treatments. The materials and/or surface treatments utilized for the cam 605, the shaft 615, and the follower 620 (among other components) may be selected based on hardness, friction lowering capabilities, anti-galling, and wear-resistance, as well as other attributes.

The interface 552 may also include a detachable spacer 635 disposed between the follower 620 and an end 612 of the housing 610. As shown in FIG. 6C, the spacer 635 may be generally U-shaped defining a slot 638 to receive the shaft 615. The spacer 635 may be detachably coupled to the follower 620 by one or more threaded fasteners 637. However, other means for detachably coupling the spacer 635, including to additional or alternative components of the interface 552, are also within the scope of the present disclosure.

The interface 552 may also include a camshaft 640 that carries the cam 605 and that is rotatable within the housing 610. The camshaft 640 and the cam 605 may be integrally formed as a single discrete member assembled within the interface 552. However, in other embodiments, the camshaft 640 and the cam 605 may be discrete components coupled together by threading, welding, or interference fit, among others. An end of the camshaft 640 may include a tool interface 670 accessible from external to the housing to rotate the cam 605 relative to the housing 610. For example, the tool interface 670 may be a recess sized to receive a ½" square drive, although the scope of the present disclosure is not limited to this one example.

The interface 552 may also include one or more bushings 645 positioned between an outer cylindrical surface of the camshaft 640 and a corresponding recess 614 of the housing 610. For example, as shown in FIG. 6C, a first bushing 645A may extend around a first end 642 of the camshaft 640 within its corresponding recess 614, and a second bushing 645B may extend around a second end 643 of the camshaft 640 within its corresponding recess 614. The one or more bushings 645 included in the interface 552 may include friction bushings. However, in other embodiments, ball bearings, needle bearings, roller bearings, and/or other types of bearings may also be utilized instead of or in addition to the bushings 645.

FIG. 6C also demonstrates that the housing 610 may include a first portion 610*a* and a second portion 610*b* detachably coupled to the first portion 610*a*. For example, one or more threaded fasteners 650 may couple the housing portions 610*a* and 610*b* together, although other coupling means are also within the scope of the present disclosure. When the two bushings 645 depicted in FIG. 6C and described above are included, the housing portions 610*a* and 610*b* may each receive a corresponding one of the bushings 645 within a corresponding recesses 614 of the housing portion. The opposing ends of the camshaft 640, and/or the bushings 645 when more than one is included, may be of different diameters, as shown in FIG. 6C, although a common diameter may also be employed for the entire length of the camshaft 640 (perhaps even for the cam 605) and/or when multiple bushings are included.

The first and second housing portions 610*a* and 610*b* may be substantially or entirely constructed of a first material, and the camshaft 640 and the cam 605 may be substantially or entirely constructed of a second material, which in certain embodiments, may be different from the first material. Moreover, when one of more bushings 645 are included, they may be substantially or entirely constructed of a third material, which may be different from the first material and/or the second material. For example, the housing portions 610*a* and 610*b* may be constructed of 17-4 stainless steel, or other stainless steels or alloys. In another example, the camshaft 640 and the cam 605 may be constructed of INCONEL, or other stainless steels or alloys. Further, the one or more bushings 645 may be constructed of bronze or an aluminum bronze alloy. However, other materials and combinations are also within the scope of the present disclosure. For example, the bushings 645 may include a steel backing with a porous bronze matrix impregnated with PTFE (polytetrafluoroethylene), among other compositions which provide wear resistance and low friction. The housing 610 may also be packed with grease and/or another lubricant, which may assist in keeping contaminants out of the mechanism during downhole operations.

As mentioned above, the interface 552 may be in different configurations during various operational stages. The sample chamber may be loaded into the interface 552 when the interface 552 is in the loading configuration, as shown in FIG. 6B. In the loading configuration, the spacer 635 is removed and the cam 605 is disengaged (in the second position), allowing the follower 620 to abut the end 612 of the housing 610. The biaser 625 is also expanded and may be compressed upon insertion of the sample chamber. After the sample chamber is inserted, the cam 605 may be rotated to the first position, to engage the cam 605 with the shaft 615, as shown in FIG. 6A, depicting the intermediate configuration. The cam 605 may move the shaft 615 away from the end 612 of the housing 610 to compress the biaser 625, thereby enlarging the gap 680 sufficiently to allow the installation of the spacer 635. The spacer 635 may hold the biaser 625 in the compressed position, thus securing the sample chamber 314 within the sample module 620.

After insertion of the spacer 635, the cam 605 may then be rotated back to the second rotational orientation to disengage the cam 605 from the shaft 615, as shown in FIG. 6E, depicting the sampling configuration. According to certain embodiments, the sample module 220 may be disposed downhole when the interface 552 is in the sampling configuration. In the sampling configuration, the cam 605 has been removed from the load path, which now extends from the sample chamber 314 to the drill collar 302 (shown in FIG. 4), through the biaser 625, the follower 620, the spacer 635, and the housing 610. As such, the biaser 625 (and/or other components of the interface 552) may absorb the axial loading of the sample chamber 314 during drilling operations.

After the drilling and/or other downhole operations are completed or temporarily halted, the downhole tool 100 (e.g., shown in FIG. 1) may be removed from the wellbore 11 to, for example, remove and/or replace the sample chambers 314. To do so, the cam 605 is again rotated to the first rotational orientation, as shown in FIG. 6A, so that the spacer 635 may be removed. Thereafter, the cam 605 may again be rotated to the second rotational orientation, such that the interface 552 is in the loading (and removal) configuration shown in FIG. 6B. When the interface 552 is in the loading (and removal) configuration, the shaft 615 and follower 620 are free to move downward (relative to the orientation shown in FIG. 6B), thus decompressing the biaser 625 and otherwise facilitating the removal of the sample chamber 314. Additional sample chambers 314 may perhaps then be loaded into the downhole tool 100, which may be reinserted into the wellbore 11 for additional sampling-while-drilling operations. Moreover, such removal and loading of the sample chambers 314 may be performed at the rig by, for example, a human operator utilizing the tool interface 670.

Figure 7:
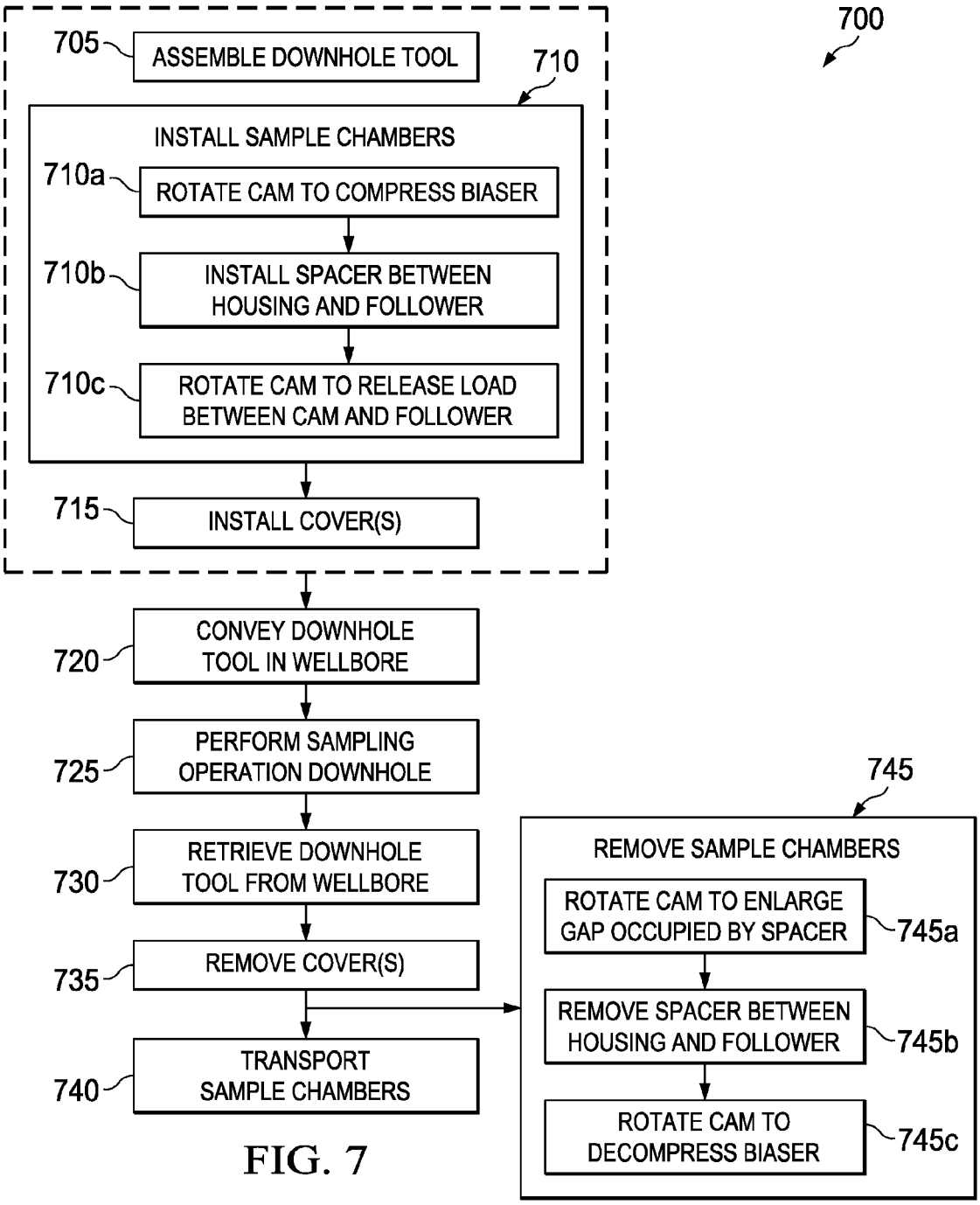
FIG. 7 is a flow-chart depicting a method for sampling, according to one or more aspects of the present disclosure.

FIG. 7 is a flow chart depicting a method 700 for loading sample chambers, according to aspects of the present disclosure. The following description of the method 700 refers to both FIG. 7 and corresponding portions of the preceding figures.

The method 700 includes assembling (block 705) the downhole tool by connecting the sample module 220 (e.g., via threaded connection) to adjacent drill collars to form the downhole tool 100. The sample module 220 may then be assembled (block 710) by loading the sample chambers 314 into the apertures 303 of the drill collar 302. This may complete the interfaces 550 and 552, thus positioning an end of the sample chamber 314 adjacent or otherwise in fluid communication with the flowline 311. The sample chamber 314 may be loaded into the sample module 220 when the interface 552 is in the loading configuration, as discussed above with respect to FIG. 6B.

Assembling the sample chambers 314 into the sample module 220 may include adjusting the interfaces 550 and/or 552 at the surface such that a minimum acceptable axial or other desirable load is applied to achieve sufficient isolation of the sample chambers 314, including within the expected operating temperature range of the sample module 220. This may compensate for higher than expected thermal expansion. The cover(s) 342 may then be positioned 715 about the sample module 220 to further secure the sample chambers 314 in place, which may seal the apertures 303 and/or otherwise inhibit contaminant access into the apertures 303 and, hence, the sample chambers 314 during downhole operations. As depicted in FIG. 7, the scope of the method 700 is not limited to any specific order in which: (1) the sample module 220 is connected 705 to the adjacent modules of the downhole tool 100; (2) the sample chambers 314 are assembled into the sample module 220; and (3) the cover(s) is positioned around the sample chamber 314.

When a sample chamber 314 is initially loaded into the interface 552, the cam 605 may be disposed in the second position, and the interface 552 may be disposed in the loading configuration, as shown in FIG. 6B. In this position, the follower 620 contacts the housing 610, and the end 617 of the shaft 615 contacts the first stage 606 (FIG. 6D) of the cam 605. The cam 605 may then be rotated 710*a* at the surface into or towards a first position, as shown in FIG. 6A. For example, the cam 605 may be manually rotated using a tool, such as a ½" square drive, manipulated by a human operator. In other embodiments, the rotation of the cam 605 may automated and/or performed by equipment. As the cam 605 rotates clockwise, the follower 620 translates axially away from the cam 605, thus compressing the biaser 625 and creating a gap 680 between the follower 620 and the housing 610.

The outer profile of the cam 605 (i.e., the surface 685 which interacts with the end 617 of the shaft 615) may include multiple portions each providing different ratios of force to angular displacement. For example, initial clockwise rotation of the cam 605 away from the second position (FIG. 6B) and towards the first position (FIG. 6A) may exhibit a greater force, e.g., angular displacement ratio relative to the concluding clockwise rotation of the cam 605 into the first position. That is, the contact surface 685 of the cam 605 may be designed to cause displacement of the shaft 615 and low axial force during a first stage for assembly purposes, while a second stage may allows for a smaller displacement and a higher mechanical advantage nearer the end of the stroke of the shaft 615 where the force of the biaser 625 may be at its maximum if the biaser 625 has a constant or otherwise non-decreasing spring constant. For example, as shown in FIG. 6D, the outer profile 685 of the cam 605 may divided into two stages. A first stage 606 may displace the shaft 615 by a first amount as the end 617 of the shaft 615 traverses the first stage 606 (e.g., the first 120 degrees of rotation of the cam 605). A second stage 607 may displace the shaft 615 by a second amount as the end 617 of the shaft 615 traverses the second stage 607 (e.g., the next 180 degrees of rotation of the cam). In certain embodiments, the second amount may be approximately 10%, 20%, 30%, or otherwise substantially less than the first amount.

In addition, the cam 605 may be self-locking. For example, the torque applied to the cam 605 by the bushings 645 (through the camshaft 640) may be greater than the torque applied to the cam 605 by the end 617 of the shaft 615 (as a result of the pressure angle of the shaft 615 relative to any point of contact on the surface of the cam 605). As a result, the cam 605 may tend to stay in the initial position, as shown in FIG. 6B, unless and until acted upon by human operator (via the tool interface 670).

After the gap 680 has been created, the spacer 635 may be inserted 710*b* into the gap 680, as shown in FIG. 6A. Thereafter, the cam 605 may be rotated counterclockwise into or towards the second position, as shown in 6E, to place the interface in the sampling configuration. In the sampling configuration, the shaft 615 is disengaged from the cam 605 and the follower 620 transfers load to the housing 610 through the spacer 635. This secures the sample chamber 314 within the sample module 220. This also establishes a load path from the sample chamber 314 through the biaser 625, the follower 620, the spacer 635, and the housing 610. As shown in FIG. 6E, in the sampling position, the end 617 of the shaft is spaced from the bushing 645 and the cam 605. Accordingly, in the second position, the cam 605 is disengaged from the shaft 617, and the load path does not, at this point in the process, include the cam 605.

Figure 8:
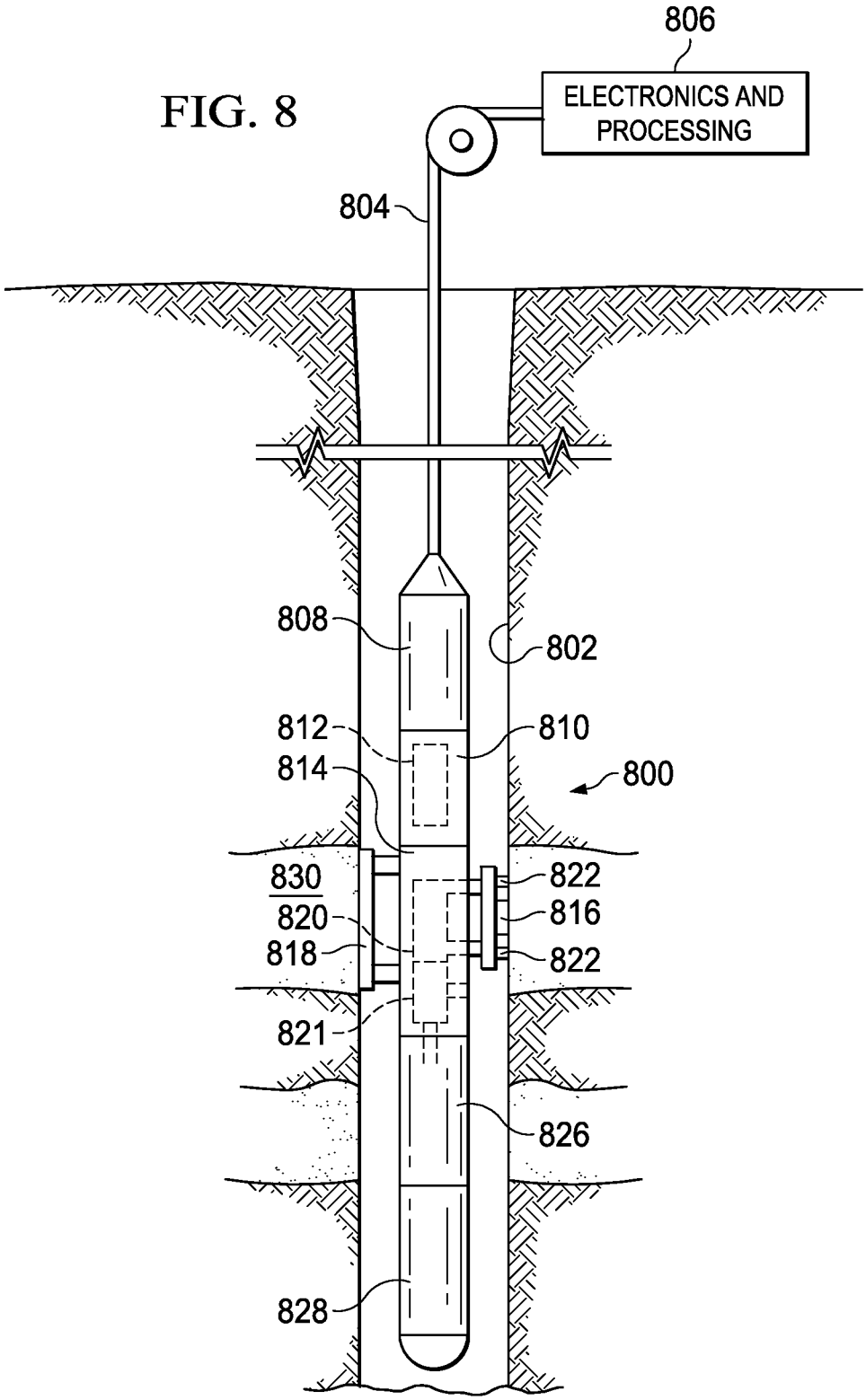
FIG. 8 is a schematic view of another embodiment of a wellsite system that may employ sample chamber assemblies, according to one or more aspects of the present disclosure.

Once the sample module 220 is assembled, the downhole tool 100 may be conveyed 720 within the wellbore 11 via drillstring 12 and/or other means (e.g., see FIG. 8 for a wireline conveyance example). A sampling operation 725 may then be performed by drawing fluid into the downhole tool 100 via the fluid communication module 210. Fluid may pass from the fluid communication module 210 to the sample module 220 via the flowline 310 (FIGS. 2A and 3). Fluid may then be diverted to one or more sample chambers 314 via the flow diverter 332 shown in FIG. 3, for example.

During this portion of the sampling operation, the valves 330*a* and/or 330*b* may remain open. For example, one of the valves 330*b* may remain open to expose the backside of the corresponding chamber piston 360 to wellbore fluid pressure. A sampling sequence may begin with a formation fluid pressure measurement, followed by a pump-out operation combined with in-situ fluid analysis (e.g., using an optical fluid analyzer of the downhole tool 100). Once a certain amount of mud filtrate has been pumped out, genuine formation fluid may also be observed as it starts to be produced along with the filtrate. When the ratio of formation fluid versus mud filtrate has reached an acceptable threshold, a decision to collect a sample can be made. Up to this point, the liquid pumped from the formation may be pumped through the fluid communication module 210 and into the wellbore via the dump flowline 260 (FIG. 3). The valves 328*a*, 328*b* may be closed, and the valve 334 may be open to direct fluid flow out through the dump flowline 260 and to the wellbore. After this flushing is achieved, the valves 328*a* may be selectively opened so as to direct fluid samples into the respective sample cavities 307 of the sample chambers 314. The valve 334 may be closed, and the valves 328*a*, 328*b* may be opened to direct fluid flow into the corresponding sample chamber 314.

After a sample chamber 314 is filled as desired, the valves 328*b* may be moved to the closed position to fluidly isolate the sample chamber 314 and capture the sample for retrieval to surface. The valves 328*a*, 328*b* may be remotely controlled manually or automatically, including via actuation from the surface via standard mud-pulse telemetry, wired drill pipe, and/or other telemetry means. Further, the control may be implemented via processing means within the downhole tool 100.

The downhole tool 100 may then be retrieved 730 from the wellbore 11. Upon retrieval of the sample module 220, the valves 330*a*, 330*b* of the sample chambers 314 may be closed by opening the one or more covers 342 to (redundantly) isolate the fluid samples therein for safeguarded transport and storage. The sample chambers 314 may then be removed 735 from the sample module 220, such as for transport 740 to a suitable lab for testing and evaluation, among other destinations within the scope of the present disclosure. Moreover, upon retrieval, new sample chambers may be installed 710, a new sample module may be assembled 705 into the downhole tool, and/or the cover(s) of the existing or new sample module may be installed 715, and the downhole tool may again be conveyed 720 within the wellbore to obtain more samples.

Removing the sample chambers 314 from the sample module 220 may include the reverse actuation of the interface 552 relative to the installation 710 described above. For example, the cam 605 may be manually rotated clockwise 745*a* to the position shown in FIG. 6A. In this position, the cam 605 applies axial force to the shaft 605 and the follower 620, reducing the axial load on the housing 610 to remove the housing 610 from the load path. This enlarges the gap 680 occupied by the spacer 635, and the spacer 635 may then be removed 745*b*. After the spacer 635 is removed, the cam 605 may then be rotated counterclockwise 745*c* such that the follower 620 translates axially toward the housing 610, thus decompressing the biaser 625 as the gap 680 reduces, as shown in FIG. 6B.

FIG. 8 is a schematic view of another example well site system to which one or more aspects of the present disclosure may also be applicable. The well site, which may be situated onshore or offshore, includes a wireline tool 800 designed to engage a portion of a sidewall of a borehole 802 penetrating a subterranean formation 830.

The wireline tool 800 may be suspended in the borehole 802 from a lower end of a multi-conductor cable 804 that may be spooled on a winch (not shown) at the Earth's surface. At the surface, the cable 804 may be communicatively coupled to an electronics and processing system 806. The electronics and processing system 806 may include a controller having an interface designed to receive commands from a surface operator. In some cases, the electronics and processing system 806 may further include a processor designed to implement one or more aspects of the methods described herein.

The wireline tool 800 may include a telemetry module 810, a formation test module 814, and a sample module 826. Although the telemetry module 810 is shown as being implemented separate from the formation test module 814, the telemetry module 810 may be implemented in the formation test module 814. The wireline tool 800 may also include additional components at various locations, such as a module 808 above the telemetry module 810 and/or a module 828 below the sample module 826, which may have varying functionality within the scope of the present disclosure.

The formation test module 814 may include a selectively extendable probe assembly 816 and a selectively extendable anchoring member 818 that are respectively arranged on opposing sides. The probe assembly 816 may be designed to selectively seal off or isolate selected portions of the sidewall of the borehole 802. For example, the probe assembly 816 may include a sealing pad that may be urged against the sidewall of the borehole 802 in a sealing manner to prevent movement of fluid into or out of the formation 830 other than through the probe assembly 816. The probe assembly 816 may thus be designed to fluidly couple a pump 821 and/or other components of the formation tester 814 to the adjacent formation 830. Accordingly, the formation tester 814 may be utilized to obtain fluid samples from the formation 830 by extracting fluid from the formation 830 using the pump 831. A fluid sample may thereafter be expelled through a port (not shown) into the borehole 802, or the sample may be directed to one or more fluid collecting chambers disposed in the sample module 826. In turn, the fluid collecting chambers may receive and retain the formation fluid for subsequent testing at surface or a testing facility.

The formation tester 814 may also be utilized to inject fluid into the formation 830 by, for example, pumping the fluid from one or more fluid collecting chambers disposed in the sample module 826 via the pump 821. Such fluid may be moved from the one or more fluid collecting chambers by applying hydrostatic pressure from within the borehole 802 to a sliding piston disposed in the collecting chamber, in addition to or in substitution of using the pump 821. While the wireline tool 800 is depicted as including one pump 821, it may also include multiple pumps. The pump 821 and/or other pumps of the wireline tool 800 may also include a reversible pump designed to pump in two directions (e.g., into and out of the formation 830, into and out of the collecting chamber(s) of the sample module 826, etc.).

The probe assembly 816 may include one or more sensors 822 adjacent a port of the probe assembly 816, among locations. The sensors 822 may be designed to determine petrophysical parameters of a portion of the formation 830 proximate the probe assembly 816. For example, the sensors 822 may be designed to measure or detect one or more of electric resistivity, dielectric constant, magnetic resonance relaxation time, nuclear radiation, and/or combinations thereof, although other types of sensors are also within the scope of the present disclosure.

The formation tester 814 may also include a fluid sensing unit 820 through which obtained fluid samples may flow to measure properties and/or composition data of the sampled fluid. For example, the fluid sensing unit 820 may include one or more of a fluorescence sensor, an optical fluid analyzer, a density and/or viscosity sensor, and/or a pressure and/or temperature sensor, among others.

The telemetry module 810 may include a downhole control system 812 communicatively coupled to the electronics and processing system 806. The electronics and processing system 806 and/or the downhole control system 812 may be designed to control the probe assembly 816 and/or the extraction of fluid samples from the formation 830, such as via the pumping rate of pump 821. The electronics and processing system 806 and/or the downhole control system 812 may be further designed to analyze and/or process data obtained from sensors disposed in the fluid sensing unit 820 and/or the sensors 822, store measurements or processed data, and/or communicate measurements or processed data to surface or another component for subsequent analysis.

One or more of the modules of the wireline tool 800 depicted in FIG. 8 may be substantially similar and/or otherwise have one or more aspects in common with corresponding modules and/or components shown herein in other figures and/or discussed above. For example, one or more aspects of the formation test module 814 and/or the sample module 826 may be substantially similar to one or more aspects of the fluid communication module 210 and/or the sample module 220, respectively, which are described above in reference to FIGS. 1-7.

In view of the entirety of the present disclosure, including the figures, one having ordinary skill in the art will readily recognize that the present disclosure introduces an apparatus comprising: a fluid communication device operable to establish fluid communication between a downhole tool and a subterranean formation penetrated by a wellbore in which the downhole tool is positioned; a sample chamber in selectable fluid communication with the formation via the fluid communication device; and an assembly mechanically coupling the sample chamber within the downhole tool and comprising a cam rotatable between a first position and a second position, wherein the cam preloads the sample chamber when in the first position but not when in the second position. The downhole tool may include a flowline in selective fluid communication with the fluid communication device, and the assembly may hydraulically couple the sample chamber with the flowline. The assembly may absorb axial loading of the sample chamber when the cam is in the second position.

The assembly may further include a housing in which the cam rotates between the first and second positions. The assembly may further include: a shaft having an end abutting the cam within the housing when the cam is in the first position; a follower carried by the shaft; and a biaser extending between the follower and a shoulder of the sample chamber, wherein a length of the biaser varies based on axial loading of the sample chamber. An outer profile of the cam may include a first portion and a second portion, wherein rotating the cam such that shaft end traverses the first portion may displace the shaft by a first amount, and wherein further rotating the cam such that the shaft end traverses the second portion may displace the shaft by a second amount that is substantially less than the first amount. The biaser may absorb axial loading of the sample chamber when the cam is in the second position. The biaser may include a spring and/or a Belleville spring stack. The end of the shaft may be a first end, and a second end of the shaft may be sized for receipt within a recess of the shoulder of the sample chamber. The shaft and the follower may be integrally formed as a single discrete member. The assembly may further include a spacer detachably coupled between the follower and an end of the housing. The spacer may include a slot within which the shaft is received.

The assembly may further include a camshaft carrying the cam and rotatable within the housing. The camshaft and the cam may be integrally formed as a single discrete member. The assembly may further include a friction bushing extending around an end of the camshaft between the camshaft and the housing. The assembly may further include: a first bushing extending around a first end of the camshaft between the camshaft and the housing; and a second bushing extending around a second end of the camshaft between the camshaft and the housing. The housing may include a first portion and a second portion detachably coupled to the first portion, wherein the first bushing may be positioned between the first end of the camshaft and the first portion of the housing, and wherein the second bushing may be positioned between the second end of the camshaft and the second portion of the housing. An end of the camshaft may include a tool interface accessible from external to the housing. The downhole tool may be conveyable within the wellbore via drill string or wireline.

The present disclosure also introduces a method comprising: installing a sample chamber into a downhole tool comprising a housing, a biaser operable to abut an end of the sample chamber, a shaft carrying a follower and extending between the biaser and the housing, and a cam rotatably supported by the housing, wherein installing the sample chamber includes: abutting an end of the sample chamber against the biaser; rotating the cam to axially translate the shaft towards the sample chamber, thereby compressing the biaser between the follower and the sample chamber and creating a gap between the follower and the housing; installing a spacer in the gap; and rotating the cam to axially translate the shaft away from the sample chamber and creating a load path from the sample chamber through the biaser, the follower, the spacer, and the housing. The downhole tool may include a plurality of recesses each operable to receive an instance of the sample chamber, and wherein the method may include repeating the sample chamber installation for each of the plurality of recesses. The downhole tool may be operable for conveyance within a wellbore extending into a subterranean formation, and the downhole tool may include a fluid communication device operable to establish fluid communication between the downhole tool and the subterranean formation. The conveyance may be via at least one of drillstring and wireline. The method may further include selectively establishing fluid communication between the installed sample chamber and the subterranean formation via at least the fluid communication device. The downhole tool may include a flowline in selective fluid communication with the fluid communication device, and installing the sample chamber may hydraulically couple the sample chamber with the flowline.

The biaser may absorb axial loading of the sample chamber when the load path does not include the cam. The biaser may include a spring and/or a Belleville spring stack.

Rotating the cam to axially translate the shaft towards the sample chamber may position an end of the shaft within a recess of a shoulder of the sample chamber. The shaft and the follower may be integrally formed as a single discrete member.

Installing the spacer in the gap may include detachably coupling the spacer between the follower and the housing. Detachably coupling the spacer between the follower and the housing may include detachably coupling the spacer to the follower.

The cam may be carried on a camshaft having ends rotatably supported by the housing, wherein one end of the camshaft may include a tool interface accessible from external to the housing, and wherein rotating the cam to axially translate the shaft towards the sample chamber and rotating the cam to axially translate the shaft away from the sample chamber may both include engaging the tool interface with a tool from external to the housing. Rotating the cam to axially translate the shaft towards the sample chamber may include rotating the cam in a first direction. Rotating the cam to axially translate the shaft away from the sample chamber may include rotating the cam in a second direction, and the first and second directions may be opposites.

The present disclosure also introduces an apparatus comprising: a downhole tool for conveyance within a wellbore extending into a subterranean formation, wherein the downhole tool includes: a fluid communication module comprising a fluid communication device operable to selectively engage a wall of the wellbore and acquire a fluid sample from the subterranean formation; and a sample module comprising: a sample chamber in selectable fluid communication with the subterranean formation via the fluid communication device; and an interface mechanically coupling the sample chamber within the sample module and comprising a cam rotatable between a first position and a second position, wherein the cam preloads the sample chamber when in the first position but not when in the second position. The fluid communication module may further include a back-up piston operable to urge the fluid communication device against the wall of the wellbore. The fluid communication module and the sample module may each include flowlines operable to selectively establish fluid communication between the fluid communication device and the sample chamber, and the interface may hydraulically couple the sample chamber with one of the flowlines. The interface may absorb axial loading of the sample chamber when the cam is in the second position. The interface may further include a housing in which the cam rotates between the first and second positions.

The interface may further include: a shaft having an end abutting the cam within the housing when the cam is in the first position; a follower carried by the shaft; and a biaser extending between the follower and a shoulder of the sample chamber, wherein a length of the biaser varies based on axial loading of the sample chamber. The biaser may absorb axial loading of the sample chamber when the cam is in the second position. The biaser may include a spring and/or a Belleville spring stack. The end of the shaft may be a first end, and a second end of the shaft may be sized for receipt within a recess of the shoulder of the sample chamber. The shaft and the follower may be integrally formed as a single discrete member.

The interface may further include a spacer detachably coupled between the follower and an end of the housing. The spacer may include a slot within which the shaft is received.

The interface may further include a camshaft carrying the cam and rotatable within the housing. The camshaft and the cam may be integrally formed as a single discrete member. The interface may further include a friction bushing extending around an end of the camshaft between the camshaft and the housing.

The interface may further include: a first bushing extending around a first end of the camshaft between the camshaft and the housing; and a second bushing extending around a second end of the camshaft between the camshaft and the housing. The housing may include a first portion and a second portion detachably coupled to the first portion, wherein the first bushing may be positioned between the first end of the camshaft and the first portion of the housing, and wherein the second bushing may be positioned between the second end of the camshaft and the second portion of the housing. An end of the camshaft may include a tool interface accessible from external to the housing. The downhole tool may be conveyable within the wellbore via drill string or wireline.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same aspects of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a fluid communication device operable to establish fluid communication between a downhole tool and a subterranean formation penetrated by a wellbore in which the downhole tool is positioned;

a sample chamber in selectable fluid communication with the formation via the fluid communication device; and an assembly mechanically coupling the sample chamber within the downhole tool and comprising a cam rotatable between a first position and a second position, wherein the cam preloads the sample chamber when in the first position and is disengaged from the sample chamber in the second position, and wherein the assembly further comprises:

a housing in which the cam rotates between the first and second positions;

a shaft having an end abutting the cam within the housing when the cam is in the first position;

a follower carried by the shaft; and a biaser extending between the follower and a shoulder of the sample chamber, wherein a length of the biaser varies based on axial loading of the sample chamber.

2. The apparatus of claim 1 wherein the downhole tool comprises a flowline in selective fluid communication with the fluid communication device, and wherein the assembly hydraulically couples the sample chamber with the flowline.

3. The apparatus of claim 1 wherein the cam is disengaged from the shaft in the second position.

4. The apparatus of claim 1 wherein an outer profile of the cam comprises a first portion and a second portion, wherein the shaft is displaced by a first amount as the shaft end traverses the first portion, and the shaft is displaced by a second amount as the shaft end traverses the second portion, wherein the second amount is substantially less than the first amount.

5. The apparatus of claim 1 wherein the biaser absorbs axial loading of the sample chamber when the cam is in the second position.

6. The apparatus of claim 1 wherein the assembly further comprises a spacer detachably coupled between the follower and an end of the housing, wherein the spacer comprises a slot within which the shaft is received.

7. The apparatus of claim 1 wherein the assembly further comprises:

a camshaft carrying the cam and rotatable within the housing;

a first bushing extending around a first end of the camshaft between the camshaft and the housing; and a second bushing extending around a second end of the camshaft between the camshaft and the housing.

8. The apparatus of claim 7 wherein an end of the camshaft comprises a tool interface accessible from external to the housing.

9. The apparatus of claim 1 wherein the downhole tool is conveyable within the wellbore via drill string or wireline.

10. A method, comprising:

installing a sample chamber into a downhole tool comprising a housing, a biaser operable to abut an end of the sample chamber, a shaft carrying a follower and extending between the biaser and the housing, and a cam rotatably supported by the housing, wherein installing the sample chamber comprises:

abutting an end of the sample chamber against the biaser;

rotating the cam to axially translate the shaft towards the sample chamber, thereby compressing the biaser between the follower and the sample chamber and creating a gap between the follower and the housing;

installing a spacer in the gap; and rotating the cam to disengage the cam from the shaft to create a load path from the sample chamber through the biaser, the follower, the spacer, and the housing.

11. The method of claim 10 wherein the downhole tool is operable for conveyance within a wellbore extending into a subterranean formation, wherein the downhole tool comprises a fluid communication device operable to establish fluid communication between the downhole tool and the subterranean formation, and wherein the method further comprises selectively establishing fluid communication between the installed sample chamber and the subterranean formation via at least the fluid communication device.

12. The method of claim 11 wherein the downhole tool comprises a flowline in selective fluid communication with the fluid communication device, and wherein installing the sample chamber hydraulically couples the sample chamber with the flowline.

13. The method of claim 10 wherein the biaser absorbs axial loading of the sample chamber when the load path does not include the cam, and wherein the biased comprises a Belleville spring stack.

14. An apparatus, comprising:

a downhole tool for conveyance within a wellbore extending into a subterranean formation, wherein the downhole tool comprises:

a fluid communication module comprising a fluid communication device operable to selectively engage a wall of the wellbore and acquire a fluid sample from the subterranean formation; and a sample module comprising:

a sample chamber in selectable fluid communication with the subterranean formation via the fluid communication device; and an interface mechanically coupling the sample chamber within the sample module and comprising a cam rotatable between a first position and a second position, wherein the cam preloads the sample chamber when in the first position and is disengaged from the sample chamber in the second position.

15. The apparatus of claim 14 wherein the fluid communication module further comprises a back-up piston operable to urge the fluid communication device against the wall of the wellbore.

16. The apparatus of claim 14 wherein the fluid communication module and the sample module each comprise flowlines operable to selectively establish fluid communication between the fluid communication device and the sample chamber, and wherein the interface hydraulically couples the sample chamber with one of the flowlines.

17. The apparatus of claim 14 wherein the interface further comprises:

a housing in which the cam rotates between the first and second positions;

a shaft having an end abutting the cam within the housing when the cam is in the first position;

a follower carried by the shaft; and a biaser extending between the follower and a shoulder of the sample chamber, wherein a length of the biaser varies based on axial loading of the sample chamber.

18. The apparatus of claim 17 wherein the interface further comprises a spacer detachably coupled between the follower and an end of the housing, and wherein the spacer comprises a slot within which the shaft is received.

19. The apparatus of claim 14 wherein the interface further comprises:

a camshaft carrying the cam and rotatable within a housing;

a first bushing extending around a first end of the camshaft between the camshaft and the housing; and a second bushing extending around a second end of the camshaft between the camshaft and the housing.

20. An apparatus, comprising:

a fluid communication device operable to establish fluid communication between a downhole tool and a subterranean formation penetrated by a wellbore in which the downhole tool is positioned;

a sample chamber in selectable fluid communication with the formation via the fluid communication device; and an assembly mechanically coupling the sample chamber within the downhole tool and comprising a cam rotatable between a first position and a second position, wherein the cam preloads the sample chamber when in the first position and is disengaged from the sample chamber in the second position, and wherein the cam is disengaged from a shaft in the second position.

* * * * *